US005942968A

United States Patent [19]

Schmidt

[11] Patent Number: 5,942,968

[45] Date of Patent: Aug. 24, 1999

[54] OVERVOLTAGE SUPPRESSOR

[75] Inventor: Walter Schmidt, Bellikon, Switzerland

[73] Assignee: Asea Brown Boveri AG, Baden, Switzerland

[21] Appl. No.: 08/852,741

[22] Filed: May 7, 1997

[30] Foreign Application Priority Data

Jun. 1, 1996 [DE] Germany ..... 196 22 140

[51] Int. Cl.[6] ..... H01C 7/10

[52] U.S. Cl. ..... 338/21; 338/21; 338/101; 338/104; 338/113; 361/117; 361/127

[58] Field of Search ..... 338/20, 21, 101, 338/102, 103, 104, 105, 106, 113; 361/117, 118, 127

[56] References Cited

U.S. PATENT DOCUMENTS

| | | | |
|---|---|---|---|
| 3,447,118 | 5/1969 | Ferree | 338/21 |
| 3,936,785 | 2/1976 | Novak | 361/127 |
| 4,107,567 | 8/1978 | Cunningham et al. | 361/117 |
| 4,812,944 | 3/1989 | Eberhard et al. . | |
| 5,050,032 | 9/1991 | Thevenet et al. | 361/127 |
| 5,138,517 | 8/1992 | Raudabaugh | 361/117 |

FOREIGN PATENT DOCUMENTS

0614198A2 9/1994 European Pat. Off. .

WO96/07186 3/1996 WIPO .

*Primary Examiner*—Michael L. Gellner
*Assistant Examiner*—Karl Easthom
*Attorney, Agent, or Firm*—Burns, Doane, Swecker & Mathis, L.L.P.

[57] ABSTRACT

The overvoltage suppressor contains two connecting fittings (1, 2), which are spaced apart from one another along an axis (z) and between which at least one cylindrical varistor element (8) is arranged. The connecting fittings (1, 2) and the at least one varistor element (8) are braced with respect to one another, forming a contact force, to form a mechanically robust active part of the overvoltage suppressor. The active part is sheathed by a molded housing made of insulating material. In each case one material cutout is formed in each of the two connecting fittings (1, 2) with a section (15, 16) which runs essentially transversely with respect to the axis (z), is designed in the form of a slot and extends from the outer surface of the fitting (1, 2) to beyond the axis (z). A loop (5), which absorbs the contact force, is inserted into the sections (15, 16), which are in the form of slots, in the region of the loop ends beyond the axis (z), and each of the two loop ends rests on in each case one surface (17, 18) which bounds the section (15, 16) which is in the form of a slot. The overvoltage suppressor is distinguished by good mechanical and electrical characteristics and can be produced in a particularly cost-effective manner.

10 Claims, 1 Drawing Sheet

Fig. 1
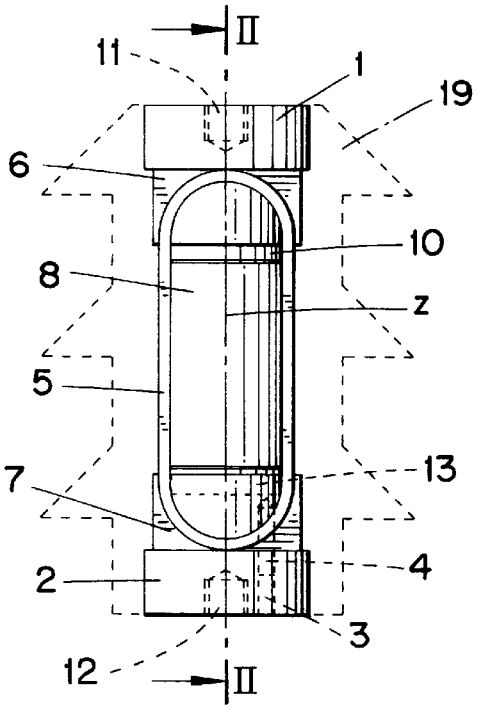
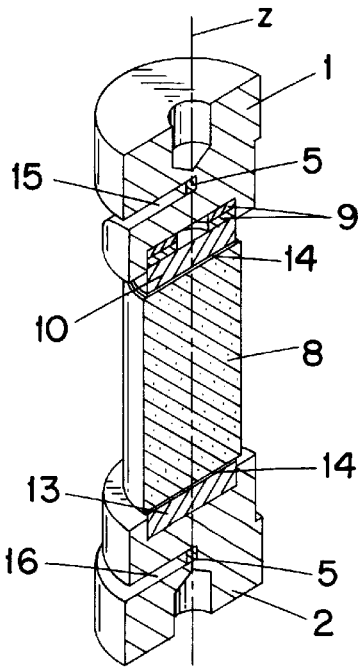
Fig. 2
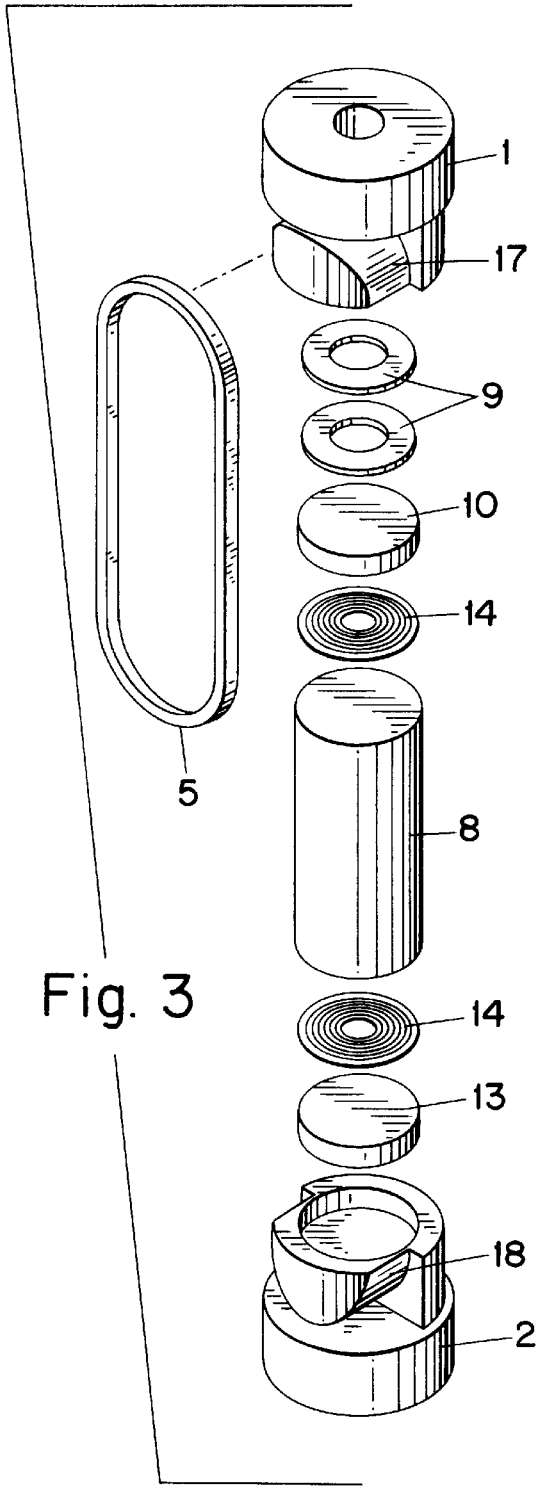
Fig. 3

OVERVOLTAGE SUPPRESSOR

BACKGROUND OF THE INVENTION

1. Field of the Invention

The invention relates to an overvoltage suppressor.

2. Discussion of Background

An overvoltage suppressor which is described in EP 0614198 A2 includes a plurality of cylindrical resistance elements having a varistor behavior, which are arranged stacked one above the other in the form of columns between two electrical connecting fittings. A clamping part, which holds the varistors and the two connecting fittings together forming an axially acting contact force has at least two loops whose ends rest on the connecting fittings. A molded housing made of a weather-resistant plastic surrounds the varistors, the loops and the predominant part of the connecting fittings.

The production of such an overvoltage suppressor is relatively complex since two or even more loops are required to fix the suppressor active part, which is in the form of a column and contains the varistors and connecting fittings, and to produce the contact force.

SUMMARY OF THE INVENTION

Accordingly, one object of the present invention is to provide an overvoltage suppressor of the type mentioned initially which, despite simple construction, is distinguished by good mechanical and electrical characteristics and which can at the same time be produced in a particularly cost-effective manner.

In comparison with an overvoltage suppressor according to the prior art, the overvoltage suppressor according to the invention has the advantage that it requires only a single loop to fix and brace two connecting fittings and at least one varistor which is held between the fittings. The overvoltage suppressor can thus be produced in a particularly economic manner. Only one prefabricated template, which temporarily ensures axial guidance, is required to assemble it, in which template the connecting fittings and the at least one varistor are initially stacked in the form of a column and are then connected, by fitting the loop, producing prestressing, to form the mechanically robust active part of the overvoltage suppressor. Since the axis of the active part, which is designed as a column, in this case passes essentially symmetrically through the loop ends, the loop produces a uniform contact force in the entire active part. Thus, this ensures a uniform current density of a suppressor current which is carried in the active part when an overvoltage occurs, and unacceptably high local heating of contact junctions in the active part is thus avoided with a high level of confidence.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a side view of an embodiment of the overvoltage suppressor according to the invention, in which a molded housing, which is indicated by dashed lines, is illustrated in transparent form, FIG. 2 shows a plan view of a section along II—II through the overvoltage suppressor according to FIG. 1 but now illustrated in perspective form, after the removal of the molded housing, and FIG. 3 shows an exploded illustration of the overvoltage suppressor according to FIG. 1, after the removal of the molded housing.

DESCRIPTION OF THE PREFERRED EMBODIMENTS

Referring now to the drawings, wherein like reference numerals designate identical or corresponding parts throughout the several views, the overvoltage suppressor which is illustrated in FIGS. 1 to 3 has two connecting fittings 1, 2, which are preferably composed of aluminum and are spaced apart from one another along an axis z. The connecting fitting 1 is provided with a fastening device, which is designed as a threaded hole 11, for an electrical conductor which may be connected to high-voltage potential, but is not illustrated. The connecting fitting 2 may be connected to ground potential by a fastening device which is designed as a threaded hole 12. Said connecting fitting 2 has an axially aligned threaded hole 3 in which a pressure screw 4 is guided such that it can be displaced in the axial direction. The designation 5 refers to a loop composed of a wound, glass-fiber-reinforced strip which is embedded in a plastic matrix. The two ends of the loop 5 are guided in sections, which are designed in the form of slots, of material cutouts 6, 7 which are formed in the connecting fittings 1, 2.

A cylindrical varistor element 8 composed of non-linear resistance material, for example based on metal oxide such as ZnO in particular, is arranged between the connecting fittings 1, 2 forming a suppressor active part in the form of a column. Alternatively, two or more varistor elements, which are stacked one above the other in the form of a column, may also be provided instead of one element 8.

Electrically conductive parts, namely two spring elements 9, which produce contact pressure and are in each case designed as plate springs, and a thrust washer 10, which is preferably composed of aluminum, copper or an aluminum or copper alloy, are mounted such that they can be displaced in the axial direction in a cutout which is in the form of a disk and is formed in the connecting fitting 1 (FIG. 2). A thrust washer 13, which is composed of the same material as the part 10, is likewise mounted such that it can be displaced in the axial direction in a cutout, which is in the form of a disk, in the connecting fitting 2 (FIG. 2). Current transmission elements 14 are arranged between the thrust washer 10 and the varistor element 8, and between the thrust washer 13 and the varistor element 8, and are in each case designed as a disk with grooves which pass concentrically around the axis and are formed in both end surfaces of the disk (FIG. 3). The current transmission elements 14 are advantageously formed from annealed aluminum.

FIG. 2 shows that each of the sections which are marked by the designations 15, 16 and are in the form of slots extend essentially transversely with respect to the axis z from the outer surface of the electrical connecting fitting 1 or 2, respectively, to beyond the axis z. Each of the two ends of the loop 5 is inserted beyond the axis z into the section 15 or 16, respectively, which is in the form of a slot, and in each case rests on a surface 17 or 18, respectively, which bounds the section 15 or 16, respectively, which is in the form of a slot (FIG. 3). This ensures that the loop 5 is held centrally in the region of the axis z, and ensures a uniform contact pressure in the suppressor active part. This ensures a uniform current density of the suppressor current which is carried in the suppressor active part when an overvoltage occurs. At the same time, unacceptably high local heating in the suppressor active part is avoided.

Increased confidence against displacement of the loop transversely with respect to the axis z is provided if the slots 15, 16 are inclined by somewhat more than 90°, for example by up to 95° with respect to the axis, and/or if the slots 15, 16 have undercuts which fix the loop ends and can be formed in the contact surfaces 17, 18.

The contact surfaces 17, 18 advantageously have a surface profile which is essentially in the form of a circular arc. The loop ends then rest on the connecting fittings 1, 2 with a uniform, relatively slight curvature. This largely avoids undesirably high bending and shear stresses in the loops.

A rectangular, in particular square, cross-sectional profile of the loop 5 with a relatively narrow width transversely with respect to the axis z is particularly advantageous since the section 15 or 16, respectively, which is designed in the form of a slot, need extend only insignificantly beyond the axis z. The connecting fitting 1 or 2 then has high mechanical strength.

The connecting fittings 1, 2 are partially enclosed, and the varistor element 8, the thrust plates 10, 13 and the loop 5 are completely enclosed, by a molded housing 19 which is provided with shields and is made of insulating material, preferably of an elastomeric silicone (FIG. 1).

In order to produce this overvoltage suppressor, the connecting fitting 2, the thrust plate 13, one of the current transmission elements 14, the varistor element 8, a further current transmission element 14, the thrust plate 10, the two spring elements 9 and the connecting fitting 1 are stacked one above the other in sequence in a template, and are subjected to a prestressing force. The connecting fittings 1, 2 are in this case aligned such that the two sections 15, 16, which are in the form of slots, are located one above the other such that they are superimposed (FIGS. 2 and 3). A prefabricated loop 5, which is preferably composed of a wound prepreg which is in the form of a strip and has been cured after winding, is then pushed so far into the slots 15, 16 that the axis z passes through the loop ends. The prestressing force is then removed, and the suppressor active part is thus complete. Contact and retention force can additionally be produced in the suppressor active part by twisting the pressure screw 4.

Instead of a prefabricated loop, a loop can also be used which is formed during the production of the overvoltage suppressor. To this end, a strip which is subjected to a prestressing force is wound around the suppressor active part and is placed on the two contact surfaces 17, 18. In this case, the two connecting fittings 1, 2 are braced firmly to one another forming a contact force, and a mechanically robust active part of the overvoltage suppressor to be produced is thus formed. This bracing is in general completely sufficient on its own for good mechanical strength of the suppressor active part. If a strip having adequate elasticity is used, such as a strip manufactured from glass fibers for example, the spring elements 9 may thus possibly be omitted.

Such a strip is preferably a prepreg, particularly based on glass fibers and epoxy resin. A prepreg has a good adhesion effect. A loop which is wound from a prestressed prepreg is thus robust even without any additional fastening device after winding, and can then be cured at elevated temperatures. A loop is then formed in this case which is composed of glass fibers and a cured plastic matrix in which the glass fibers are embedded.

In addition to making good contact with the individual parts which are located in the current path between the two connecting fittings, the bracing of the two connecting fittings 1, 2 at the same time also results in the grooves of the current transmission elements 14 being closely joined at the end surfaces of the varistor element 8 and of the thrust washers 10, 13. If the suppressor active part is subsequently extrusion coated with insulating material, preferably based on an elastomeric silicone, this avoids ingress of the liquid insulating material between the individual parts located in the current path.

Obviously, numerous modifications and variations of the present invention are possible in light of the above teachings. It is therefore to be understood that within the scope of the appended claims, the invention may be practiced otherwise than as specifically described herein.

LIST OF DESIGNATIONS

| | |
|---|---|
| 1, 2 | Connecting fittings |
| 3 | Threaded hole |
| 4 | Pressure screw |
| 5 | Loop |
| 6, 7 | Material cutouts |
| 8 | Varistor element |
| 9 | Spring elements |
| 10 | Thrust washer |
| 11, 12 | Threaded holes |
| 13 | Thrust washer |
| 14 | Current transmission elements |
| 15, 16 | Sections in the form of slots |
| 17, 18 | Contact surfaces |
| 19 | Molded housing |
| z | Axis |

What is claimed as new and desired to be secured by Letters Patent of the United States is:

1. An overvoltage suppressor comprising:

a columnar active part having a central column axis, said active part including two connecting fittings which are spaced apart from one another along said column axis and each include an outer surface;

at least one cylindrical varistor element arranged between said two connecting fittings;

a clamping part which holds said connecting fittings and said at least one varistor element together with a contact force, said clamping part including a loop made of insulating material and having two loop ends;

a molded housing made of electrical insulating material which at least partially sheaths said at least one varistor element and said clamping part;

a material cutout in each of said two connecting fittings, said material cutouts each having a slot section which extends transversely with respect to said column axis from said outer surface of each of said two connecting fittings to beyond said column axis, each of said slot sections having a contact surface which bounds said slot section; and wherein said loop is positioned in said slot sections in said two connecting fittings, and each of said two loop ends rests on one of said slot section contact surfaces.

2. The overvoltage suppressor as claimed in claim 1, wherein each of said contact surfaces includes a circular arc surface profile.

3. The overvoltage suppressor as claimed in claim 1, wherein said clamping part further comprises at least one contact force producing element selected from the group consisting of a spring, a thrust washer, and both, and a disk cutout in at least one of said two connecting fittings which receives said at least one contact force producing element.

4. The overvoltage suppressor as claimed in claim 1, wherein said loop comprises a wound strip.

5. The overvoltage suppressor as claimed in claim 4, wherein said loop comprises a wound strip embedded in a plastic matrix.

6. The overvoltage suppressor as claimed in claim 5, wherein said plastic matrix is formed by a step of curing a curable plastic before said loop is placed on said contact surfaces.

7. The overvoltage suppressor as claimed in claim 6, wherein said plastic matrix is formed by a step of curing a curable plastic after said loop is placed on said contact surfaces.

8. The overvoltage suppressor as claimed in claim 1, wherein said loop has a rectangular cross-sectional profile.

9. The overvoltage suppressor as claimed in claim 1, wherein said two connecting fittings define a current path, and further comprising at least one deformable current transmitting element provided in said current path.

10. The overvoltage suppressor as claimed in claim 9, wherein said current transmitting element comprises a disk having end surfaces, said disk including concentric grooves in said end surfaces which pass around said column axis.

* * * * *